United States Patent [19]

Wachsmann et al.

[11] 4,011,829

[45] Mar. 15, 1977

[54] CLOSURE HAVING INDICATING MEANS

[76] Inventors: Doris Beryl Wachsmann, 1666 Malvern Road, Glen Iris, Victoria 3146; Reginald Francis Thomas, Taradale Garage, Calder Highway, Taradale, Victoria 3447, both of Australia

[22] Filed: Sept. 24, 1975

[21] Appl. No.: 616,303

[30] Foreign Application Priority Data

| | | |
|---|---|---|
| Oct. 1, 1974 | Australia | 9102/74 |
| Nov. 19, 1974 | Australia | 9663/74 |
| Apr. 8, 1975 | Australia | 1159/75 |

[52] U.S. Cl. ..... 116/121; 215/201; 206/534; 215/216

[51] Int. Cl.[2] ..... G09F 9/00

[58] Field of Search ..... 116/121; 206/534, 528; 215/201, 216

[56] References Cited

UNITED STATES PATENTS

| | | | |
|---|---|---|---|
| 3,151,599 | 10/1964 | Livingston | 116/121 |
| 3,891,110 | 6/1975 | Gach | 215/216 |

*Primary Examiner*—George T. Hall
*Attorney, Agent, or Firm*—Cushman, Darby & Cushman

[57] ABSTRACT

A container closure which indicates the number of times which a container is opened comprises a counting screw cap for a container three members arranged for rotation relative to one another, the first member threadedly engaging the neck of the container, the second member being arranged to be manually grasped for removing the cap from the container, there being provided a lost motion drive between the first and second members so that the second member is enabled to rotate through a predetermined angle in each direction without causing rotation of said first member while rotation of the second member beyond the predetermined angle causes rotation of the first member to screw the latter onto, or remove it from, the neck of the container. The third member carries indicating means and is interposed between the first and second members in such manner that it is driven by the second member during a substantial part of the lost motion rotation of the second member in one direction and restrained against motion by the first member during a substantial part of the lost motion rotation of the second member in the opposite direction. The indicating means cooperates with a series of numbers marked on one of first or second members.

8 Claims, 5 Drawing Figures

CLOSURE HAVING INDICATING MEANS

This invention relates to an improved counting device and more particularly to a counting device which can be used to indicate the number of times a container has been opened. The main application of the invention is at present seen as a screw cap or cork for bottles, jars and the like containing pharmaceuticals, the counting mechanism being a reliable guide to the patient who has difficulty in remembering whether a particular dose has or has not been taken. It is intended that the counting device be set at zero at the beginning of each day after which it will advance one number for each time that the container is opened or closed.

The invention also relates to an improved screw cap for containers, and more particularly to an improved safety cap.

In recent years there has been considerable concern at the number of fatal and near fatal accidents caused by small children obtaining access to tablets and other pharmaceutical products. Efforts have therefore been made to produce caps which cannot be opened by pre-school-age children. Such caps usually require the person opening them to perform at least two simultaneous operations or involve the operation of a hidden button or the like.

All of the prior constructions known to the present inventors suffer from disadvantages such as being difficult to make and therefore too costly, or being difficult to operate. Difficulty of operation in some cases results from slight inaccuracies in manufacture. The present invention is intended to overcome these disadvantages by providing a simple construction and one in which slight inaccuracies in manufacture will not have an adverse effect on the operability or effectiveness of the safety aspect of the construction.

The invention also relates to a container and a closure for a container which provides both counting means and a safety device.

According to one of its aspects the invention provides a counting screw cap for a container comprising three members arranged for rotation relative to one another, the first of said members being provided with an internal screw thread for engagement with a complementary screw thread on the neck of a container, the second of said members being arranged to be manually grasped for removing the cap from the container and replacing it on the container, there being provided a lost motion drive between said first and second members whereby said second member is enabled to rotate through a predetermined angle in each direction without causing rotation of said first member while rotation of the second member beyond the predetermined angle causes rotation of the first member to screw the latter onto, or remove it from, the neck of the container, the third member being interposed between the first and second members in such manner that it is driven by the second member during a substantial part of the lost motion rotation of the second member relative to the first member in one direction and restrained against motion by the first member during a substantial part of the lost motion rotation of the second member relative to the first member in the opposite direction, a series of numbers marked on one of said members at an angular spacing slightly less than said predetermined angle, and indicating means associated with one of said members other than the one on which said numbers are marked, one of said member carrying said numbers and said member having indicating means being said third member, and said indicating means in co-operation with said numbers indicating the number of times said second member has been caused to perform a cycle of one rotation in one direction relative to said first member through at least said predetermined angle and one rotation in the opposite direction relative to said first member through at least said predetermined angle.

According to another of its aspects the invention provides a safety container having a screw-threaded opening and cap to close said opening, the cap being provided adjacent the lower edge of its skirt with one or more recesses and the container body being provided with one or more detents spring-biased into engagement with the said recess or recesses.

According to a further aspect of the invention there is provided a safety container having a screw-threaded opening and a cap to close said opening, the cap comprising three members arranged for rotation relative to one another, the first of said members being provided with an internal screw-thread for engagement with a complementary screw-thread on the neck of the container, the second of said members being arranged to be manually grasped for removing the cap from the container and placing it on the container, there being provided a lost motion drive between said first and second members where the said second member is enabled to rotate through a predetermined member in each direction without causing rotation of said first member while rotation of the second member beyond the predetermined angle causes rotation of the first member to screw the latter on to, or remove it from, the neck of the container, the third member being interposed between the first and second members in such manner that it is driven by the second member during a substantial part of the lost motion rotation of the second member relative to the first member in any one direction and restrained against motion by the first member during a substantial part of the lost motion rotation of the second member relative to the first member in the opposite direction, a series of numbers marked on one of said members at an angular spacing slightly less than said predetermined angle, and indicating means associated with one of said members other than the one on which said numbers are marked, one of said member carrying said numbers and said member having indicating means being said third member, and said indicating means in co-operation with said numbers indicating the number of times said second member has been caused to perform a cycle of one rotation in one direction relative to said first member through at least said predetermined angle and one rotation in the opposite direction relative to said first member through at least said predetermined angle, the cap being provided in the lower edge of at least one of the first and second members with one or more recesses and the container body being provided with one or more detents spring-biased into engagement with said recess or recesses when the cap is placed on the container.

In order that the invention may be more readily understood it will now be described by way of example with reference to the accompanying drawings wherein.

Figure 1:
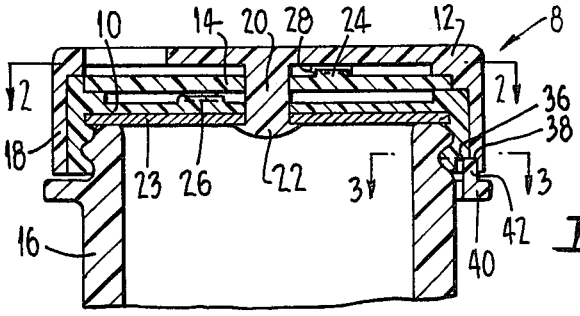
FIG. 1 is a cross-sectional view of the neck of a container fitted with a closure according to the present invention.

The drawings illustrate a closure generally indicated at 8 consisting of three members 10, 12 and 14 installed on the screw-threaded neck of a container 16. The first member 10 is provided with an internal screw-thread for engagement with the screw-thread on the neck of the container.

The second member 12 is provided with a skirt 18 which surrounds member 10 and is provided with an integral co-axial projection 20 having an arrow-head 22 adapted to be forced through a central aperture in third member 14 and in first member 10 to assemble the cap, but of a diameter large enough to prevent the arrow-head being withdrawn from members 10 and 14 by any normal force which will be encountered in the use of the device. If desired a sealing disc 23 may be used between first member 10 and the neck of the container.

The third member 14 consists of a rotatable disc with numbers engraved on its upper face. Member 14 is formed on its upper and lower surfaces with an appropriate number of wedge-shaped projections 24 for engagement with a wedge-shaped projection 26 on the upper surface of member 10 and with a wedge-shaped projection 28 on the lower surface of member 12. Instead of projections 24 it is possible to use similarly shaped depressions or holes but the drawing shows the projections for the sake of convenience. In the assembled condition of the closure, projections 26 and 28 are located approximately diametrically opposite each other.

The upper surface of third member 14 is marked with numbers from 0 to 9 spaced at equal intervals in a circle concentric with the member. Second member 12 is provided with an aperture through which the numbers may be viewed one at a time.

A lost motion drive connection between first member 10 and second member 12 is provided by means of upward projections 32 on first member 10 and downward projections 34 on second member 12. The extent of the lost motion between members 10 and 12 is related to the number of numbers inscribed on the upper surface of member 14. In the present case there are 10 numbers from which it follows that the relative movement between members 12 and 14 per cycle of operations of the cap must be 36°. To permit clearance and to accommodate possible inaccuracies in manufacture it is preferred that the lost motion be of the order of 40°. In the present case the circumferential extent of each of the projections 32 and 34 is 50° and each of the spaces between the two projections on each of the members 10 and 12 is 90°.

The lower edge of the skirt member 10 is provided with a wedge-shaped recess 36, and the lower edge of the skirt 18 of member 12 is provided with a similar wedge-shaped recess 38. Recess 36 preferably extends through the full thickness of the lower edge of member 10, but recess 38 in the lower edge of member 12 preferably extends only part way through the thickness of the skirt of member 12 and is not visible on inspection from the outside of the container when the cap is in position.

The cap is adapted to screw down almost into engagement with a ridge 40 which surrounds the neck of the cap. The ridge is made of a flexible but durable plastic material and, in the case of a plastic container, may be moulded integrally with the container. In the case of a glass container the ridge may be moulded on to the neck of the container after the usual manufacturing processes have been completed.

Alternatively in the case of a glass container the ridge may be made of a plastic material which is heat shrinkable. It is made over size, positioned on the neck of the container and then heated to shrink it into firm engagement with the container.

Figure 3:
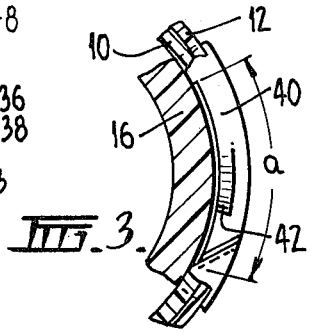
FIG. 3 is a fragmentary cross-sectional view on line 3—3 of FIG. 1.
Figure 2:
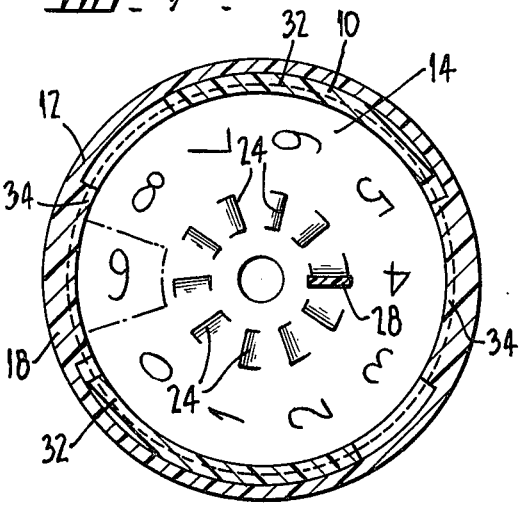
FIG. 2 is a cross-sectional plan view on line 2—2 of FIG. 1.
Figure 5:
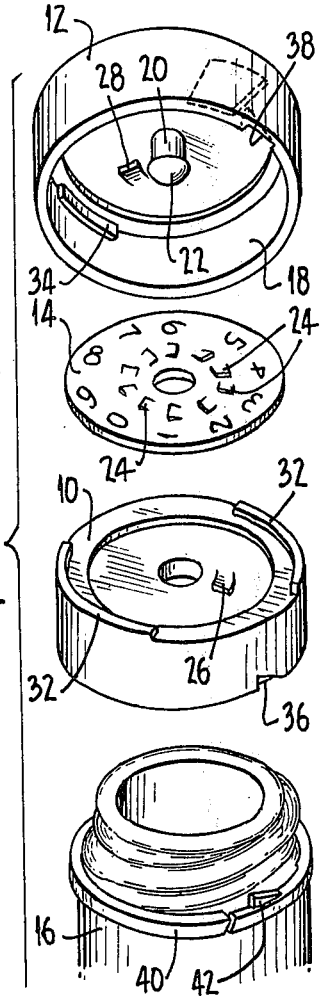
FIG. 5 is an exploded perspective view on the neck of the container and the closure gap.
Figure 4:
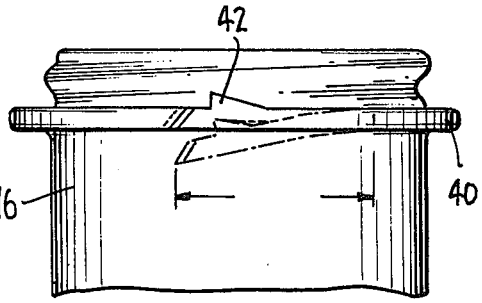
FIG. 4 is an exterior view of the neck of the container of FIG. 1.

A part of the ridge is separated from the neck of the container over a length marked as (a) in FIGS. 3 and 4 to form a cantilever spring and is provided with an upwardly directed wedge-shaped tooth 42.

The operation of the counting device is as follows:

With the cap fully screwed on to the container, second member 12 is at the limit of its clockwise movement (as viewed in plan) relative to member 10. At this stage recesses 36 and 38 are aligned with each other and are engaged by tooth 42 to prevent opening of the container. Second member 12 is released by engaging ridge 40 with a thumb nail or other suitable device and drawing it downwardly to the position illustrated in dotted lines in FIG. 4. Second member 12 can then be rotated anti-clockwise until it comes to the other limit of its lost motion relative to first member 10.

During the major part of this rotation, tooth 28 on member 12 is in engagement with one of the projections or depressions 24 on third member 14, and consequently turns member 14 through an angle of 36°, i.e., a sufficient distance to bring the next number into view through aperture 30. Further rotation of member 12 in the anti-clockwise direction (assuming that tooth 42 is still held depressed), causes projections 34 on member 12, which are in engagement with projections 32 on member 10, to rotate member 10 to remove the cap from the container.

To replace the cap on container the thread of member 10 is engaged with the thread on the neck of the container and member 12 is rotated in a clock-wise direction. When member 10 reaches the limit of its available movement on to the container neck, it ceases to rotate, but member 12 continues to rotate until it has used up the available lost motion between members 10 and 12. During this last part of the rotation of member 12, member 14 is held against rotation by engagement of tooth 26 on member 10 with one of the projections or depressions 24 on the lower face of member 14. The counting mechanism is then cocked ready for the next operation. If necessary, member 12 is rotated a little past the point at which its lost motion relative to member 10 has been completed to engage tooth 42 in recesses 36 and 38 and to compress sealing disc 23.

As modifications within the spirit and scope of the invention may readily be effected by persons skilled in the art, it is to be understood that this invention is not limited to the details of the particular embodiment described by way of example hereinabove.

For example the numbers used to indicate the number of times that the container has been opened can be printed or engraved in reverse order to that they show the number of tablets or the like remaining in the container rather than the number dispensed. The invention has been described in connection with a series of numerals from 1 to 10 but this can be altered to suit different requirements. As an example there could be 28 numerals of which 21 could be printed in green with the remaining 7 in red. The numerals could be printed in a double row if necessary and could be used to facilitate taking birth control pills to provide an automatic check on whether the pill for any particular day had been taken. The numerals could be printed in a luminous substance or could be raised or printed in braille. Additionally the use of the invention is not necessarily restricted to containers for medicines and pharmaceuticals. It can be applied to any situation in which it is desirable to have a check on the number of times a container has been opened and closed.

We claim:

1. A counting screw cap for a container comprising three members arranged for rotation relative to one another, the first of said members being provided with an internal screw thread for engagement with a complementary screw thread on the neck of the container, the second of said members being arranged to be manually grasped for removing the cap from the container and replacing it on the container, there being provided a lost motion drive between said first and second members whereby said second member is enabled to rotate through a predetermined angle in each direction without causing rotation of said first member while rotation of the second member beyond the predetermined angle causes rotation of the first member to screw the latter onto, or remove it from, the neck of the container, the third member being interposed between the first and second members in such manner that it is driven by the second member during a substantial part of the lost motion rotation of the second member relative to the first member in one direction and restrained against motion by the first member during a substantial part of the lost motion rotation of the second member relative to the first member in the opposite direction, a series of numbers marked on one of said members at an angular spacing slightly less than said predetermined angle, and indicating means associated with one of said members other than the one on which said numbers are marked, one of said member carrying said numbers and said member having indicating means being said third member, and said indicating means in co-operation with said numbers indicating the number of times said second member has been caused to perform a cycle of one rotation in one direction relative to said first member through at least said predetermined angle and one rotation in the opposite direction relative to said first member through at least said predetermined angle.

2. A safety container having a screw-threaded opening and a cap to close said opening, the cap comprising three members arranged for rotation relative to one another, the first of said members being provided with an internal screw-thread for engagement with a complementary screw-thread on the neck of the container, the second of said members being arranged to be manually grasped for removing the cap from the container and placing it on the container, there being provided a lost motion drive between said first and second members where the said second member is enabled to rotate through a predetermined number in each direction without causing rotation of said first member while rotation of the second member beyond the predetermined angle causes rotation of the first member to screw the latter on to, or remove it from, the neck of the container, the third member being interposed between the first and second members in such manner that it is driven by the second member during a substantial part of the lost motion rotation of the second member relative to the first member in any one direction and restrained against motion by the first member during a substantial part of the lost motion rotation of the second member relative to the first member in the opposite direction, a series of numbers marked on one of said members at an angular spacing slightly less than said predetermined angle, and indicating means associated with one of said members other than the one on which said numbers are marked, one of said member carrying said numbers and said member having indicating means being said third member, and said indicating means in co-operation with said numbers indicating the number of times said second member has been caused to perform a cycle of one rotation in one direction relative to said first member through at least said predetermined angle and one rotation in the opposite direction relative to said first member through at least said predetermined angle, the cap being provided in the lower edge of at least one of the first and second members with one or more recesses and the container body being provided with one or more detents spring-biased into engagement with said recess or recesses when the cap is placed on the container.

3. A container closure which indicates the number of times a container is opened, comprising:

a sealing member providing a sealing engagement with said container, a manually operable member secured to said sealing member and being rotatable with respect thereto through a predetermined angle, said second member including means for engaging said sealing member after said second member has been rotated with respect to said sealing member through said predetermined angle, said second member having an aperture therethrough, and a count indicator member interposed between said sealing and said second members, said indicator member being rotated by said second member with respect to said sealing member when said second member is rotated with respect to said sealing member in a first direction, and means for inhibiting the rotation of said count indicator means with respect to said sealing member when said second member is rotated with respect to said sealing member in the opposite direction, a plurality of numbers being marked on said count indicator member at angular spacings substantially equal to that of said predetermined angle, succeeding ones of said numbers coming into registry with respect to said aperture in said second member as said second member is rotated with respect to said sealing member.

4. A container closure which indicates the number of times a container is opened, comprising:

a first sealing member for providing a sealing engagement with said container, a manually operable second member secured to said sealing member and being rotatable with respect thereto through a predetermined angle and thereafter engaging said sealing member to rotate said sealing member to thereby remove said closure from said container or to secure said closure to said container, a count indicator member interposed between said sealing and said second members, said indicator means being rotated by said second member when said second member is rotated with respect to said sealing member in a first direction and being inhibited from rotating with respect to said sealing member by engagement therewith when said second member is rotated in the opposite direction, a plurality of numbers being marked on said count indicator member at angular spacings corresponding substantially to that of said predetermined angle, succeeding ones of said numbers coming into registry with said aperture in said second member as said second member is rotated with respect to said sealing member.

5. A container closure which indicates the number of times a container is opened, comprising:

a sealing member for providing a sealing engagement with said container, a manually operable second member secured to said sealing member and being movable with respect thereto, said second member having an aperture therethrough, a count indicator member interposed between said sealing member and said second member, and means for rotating said count indicator member with respect to said second member when said second member is moved with respect to said sealing member in a first direction to remove said closure from said container and in a second direction to close said container, a plurality of numbers being marked on said count indicator member at angular spacings corresponding to the relative rotation of said count indicator member and said second member when said second member is moved with respect to said sealing member in said first opening and said second closing directions, succeeding ones of said numbers coming into registry with respect to said aperture in said second member as said second member is moved with respect to said sealing member.

6. A safety container which indicates the number of times a container is opened, comprising:

a body having a neck portion, a cap for closing about said neck portion of said body, said cap including a sealing member for providing a sealing engagement with said container, a manually operable second member secured to said sealing member and being rotatable with respect thereto through a predetermined angle, said second member including means for engaging said sealing member after said second member has been rotated with respect to said sealing member through said predetermined angle, said second member having an aperture therethrough, and a count indicator member interposed between said sealing member and said second member, said indicator member being rotated with respect to said sealing member by said second member when said second member is rotated with respect to said sealing member in a first direction and being inhibited from rotating with said second member by engagement with said sealing member when said second member is rotated with respect to said sealing member in an opposite direction, a plurality of numbers being marked on said count indicator member at angular spacings corresponding substantially to that of said predetermined angle, succeeding ones of said numbers coming into registry with said aperture in said second member as said second member is rotated with respect to said first member, and spring biased means for normally inhibiting the rotation of said cap with respect to said body to prevent the removal of said cap from said body, said spring biased means being manually movable against said spring bias to enable the relative rotation of said cap with respect to said body to enable removal of said cap from said body.

7. A safety container which indicates the number of times a container is opened, comprising:

a body having a screw-threaded neck portion, a cap including a sealing member for providing a sealing engagement with said container, said sealing member having a skirt portion with the internal periphery thereof threaded to mate with the threaded neck portion of said body, a manually operable member secured to said first member and being rotatable with respect thereto through a predetermined angle after which said second member engages said sealing member to rotate said sealing member therewith, said second member having an aperture therethrough, and a count indicator member interposed between said sealing and said second members, said indicator member being rotated by said second member with respect to said sealing member when said second member is rotated with respect to said sealing member in a first direction and being inhibited from rotating with said second member by engaging said sealing member when said second member is rotated with respect to said sealing member in the opposite direction, a plurality of numbers being provided on said count indicator member at angular spacings substantially equal to that of said predetermined angle, succeeding ones of said numbers coming into registry with said aperture in said second member as said second member is rotated with respect to said sealing member, and a spring biased means fixed to said body for normally engaging at least one recess in the sealing member to thereby inhibit rotation of said cap with respect to said body to inhibit the removal of said cap from said body and being manually movable out of engagement with said recess to enable the rotation of said cap with respect to said body to thereby enable removal of said cap from said body.

8. A safety container closure which indicates the number of times a container is opened, comprising:

a body having a neck portion, a cap for closing said neck portion, said cap including a sealing member for providing a sealing engagement with said container, a manually operable second member secured to said sealing member and being movable with respect thereto, said second member having an aperture therethrough, a count indicator member interposed between said sealing member and said second member, and means for rotating said count indicator member with respect to said second member when said second member is moved with respect to said sealing member in a first direction to remove said closure from said container and in a second direction to close said container, a plurality of numbers being marked on said count indicator member at angular spacings corresponding to the relative rotation of said count indicator member and said second member when said second member is moved with respect to said sealing member in said first opening and said second closing directions, succeeding ones of said numbers coming into registry with respect to said aperture in said second member as said second member is moved with respect to said sealing member, and spring biased means for normally inhibiting the removal of said cap from said body, said spring biased means being manually movable against said spring bias to enable the removal of said cap from said body.

* * * * *